US005423997A

United States Patent [19]

Ahmed et al.

[11] Patent Number: 5,423,997

[45] Date of Patent: Jun. 13, 1995

[54] SPRAY DRIED POWDERED AUTOMATIC DISHWASHING COMPOSITION CONTAINING ENZYMES

[75] Inventors: Fahim U. Ahmed, Cranbury; Divaker Kenkare, Asbury, both of N.J.

[73] Assignee: Colgate Palmolive Co., Piscataway, N.J.

[21] Appl. No.: 112,046

[22] Filed: Aug. 26, 1993

Related U.S. Application Data

[63] Continuation-in-part of Ser. No. 932,124, Aug. 19, 1992, which is a continuation-in-part of Ser. No. 708,576, May 31, 1991, Pat. No. 5,173,207, and a continuation-in-part of Ser. No. 708,557, May 31, 1991, abandoned, and a continuation-in-part of Ser. No. 708,559, May 31, 1991, abandoned.

[51] Int. Cl.[6] ..... C11D 3/386; C11D 3/395; C11D 3/37

[52] U.S. Cl. ..... 252/99; 252/174.12; 252/DIG. 12; 252/174.23; 252/174.24; 252/174.25; 252/95; 252/135

[58] Field of Search ..... 252/135, 174.12, 174.25, 252/DIG. 12, 174.24, 95, 99

[56] References Cited

U.S. PATENT DOCUMENTS

| | | | |
|---|---|---|---|
| 3,764,542 | 10/1973 | Natal | 252/135 |
| 4,087,368 | 5/1978 | Borrello | 252/89 R |
| 4,162,987 | 7/1979 | Maguire, Jr. et al. | 252/135 |
| 4,176,079 | 11/1979 | Guerry et al. | 252/90 |
| 4,597,886 | 7/1986 | Goedhart et al. | 252/95 |
| 4,931,203 | 6/1990 | Ahmed et al. | 252/99 |
| 5,173,207 | 10/1992 | Drapier | 252/99 |

*Primary Examiner*—Paul Liberman
*Assistant Examiner*—Kery A. Fries
*Attorney, Agent, or Firm*—Richard E. Nanfeldt; Robert C. Sullivan; Murray Grill

[57] ABSTRACT

A spray dried phosphate-free ultra concentrated powdered automatic dishwashing detergent composition containing a mixture of protease enzyme and an amylase enzymes have been found to be very useful in the cleaning of dishware. The compositions contain nonionic surfactants, a builder salt system, a zeolite and an alkali metal silicate and optionally bleaching agent and bleaching activator.

6 Claims, No Drawings

SPRAY DRIED POWDERED AUTOMATIC DISHWASHING COMPOSITION CONTAINING ENZYMES

This application is a continuation-in-part of U.S. application Ser. No. 07/932,124 filed on Aug. 19, 1992 which in turn is a continuation in part application of U.S. Ser. No. 07/708,576 filed May 31, 1991, now U.S. Pat. No. 5,133,203 and is also a continuation in part application U.S. Ser. No. 07/708,557 filed May 31, 1991 abandoned and is also a continuation in part application of U.S. Ser. No. 07/708,559 filed May 3, 1991, abandoned.

FIELD OF THE INVENTION

This invention relates to an improved spray dried powdered phosphate-free automatic dishwashing detergent for use in dishwashing machines. More particularly, this invention relates to a concentrated powdered dishwashing composition which contains enzymes and is phosphate-free.

BACKGROUND OF THE INVENTION

It has been found to be very useful to have enzymes in dishwashing detergent compositions because enzymes are very effective in removing food soils from the surface of glasses, dishes, pots, pans and eating utensils. The enzymes attack these materials while other components of the detergent will effect other aspects of the cleaning action. However, in order for the enzymes to be highly effective, the composition must be chemically stable, and it must maintain an effective activity at the operating temperature of the automatic dishwasher. Chemical stability, such as to bleaching agents, is the property whereby the detergent composition containing enzymes does not undergo any significant degradation during storage. Activity is the property of maintaining enzyme activity during usage. From the time that a detergent is packaged until it is used by the customer, it must remain stable. Furthermore, during customer usage of the dishwashing detergent, it must retain its activity. Unless the enzymes in the detergent are maintained in a minimum exposure to moisture or water, the enzymes will suffer a degradation during storage which will result in a product that will have a decreased activity. When enzymes are a part of the detergent composition, it has been found that the initial water content of the components of the composition should be as low a level as possible, and this low water content must be maintained during storage, since water will deactivate the enzymes. This deactivation will cause a decrease in the initial activity of the detergent composition.

After the detergent container is opened, the detergent will be exposed to the environment which contains moisture. During each instance that the detergent is exposed to the environment it could possibly absorb some moisture. This absorption occurs by components of the detergent composition absorbing moisture, when in contact with the atmosphere. This effect is increased as the container is emptied, since there will be a greater volume of air in contact with the detergent, and thus more available moisture to be absorbed by the detergent composition. This will usually accelerate the decrease in the activity of the detergent composition. The most efficient way to keep a high activity is to start with an initial high activity of enzyme and to use components in the dishwashing composition which do not interact with the enzyme or which have a low water affinity which will minimize any losses in activity as the detergent is being stored or used.

Powdered detergent compositions which contain enzymes can be made more stable and to have a high activity, if the initial free water content of the detergent composition is less than about 10 percent by weight, more preferably less than about 9 percent by weight and most preferably less than about 8 percent by weight. Furthermore, the pH of a 1.0 wt % aqueous solution of the powdered detergent composition should be less than about 11.8, more preferably less than about 11.5, and most preferably less than about 11.0. This low alkalinity of the dishwashing detergent should maintain the stability of the detergent composition which contains a mixture of enzymes, thereby providing a higher initial activity of the mixture of the enzymes and the maintenance of this initial high activity.

A major concern in the use of automatic dishwashing compositions is the formulation of phosphate-free compositions which are safe to the environment while maintaining superior cleaning performance and dish care. The present invention teaches the preparation and use of powdered automatic dishwashing compositions which are phosphate-free and have superior cleaning performance and dish care.

SUMMARY OF THE INVENTION

This invention is directed to producing powdered phosphate-free enzyme-containing automatic dishwashing detergent compositions that have an increased chemical stability and essentially high activity at wash operating temperatures of about 40° C. (104° F.) to 65° C. (150° F.), wherein the composition also can be used as a laundry pre-soaking agent. This is accomplished by controlling the alkalinity of the detergent composition and using a unique mixture of enzymes. An alkali metal silicate is used in the powdered dishwashing detergent compositions. The preferred builder system of the instant compositions comprises a mixture of zeolite A, sodium carbonate, and/or sodium citrate and a low molecular weight polyacrylic polymer. Conventional powdered automatic dishwashing compositions usually contain a low foaming surface-active agent, a chlorine bleach, alkaline builder materials, and usually minor ingredients and additives. The incorporation of chlorine bleach requires special processing and storage precautions to protect composition components which are subject to deterioration upon direct contact with the active chlorine. The stability of the chlorine bleach is also critical and raises additional processing and storage difficulties. In addition, it is known that automatic dishwasher detergent compositions may tarnish silverware and damage metal trim on china as a result of the presence of a chlorine-containing bleach therein. Accordingly, there is a standing desire to formulate detergent compositions for use in automatic dishwashing operations which are free of active chlorine and which are capable of providing overall hard surface cleaning and appearance benefits comparable to or better than active chlorine-containing detergent compositions. This reformulation is particularly delicate in the context of automatic dishwashing operations, since during those operations, the active chlorine prevents the formation and/or deposition of troublesome protein and protein-grease complexes on the hard dish surfaces and no surfactant system currently known is capable of adequately performing that function.

Various attempts have been made to formulate bleach-free low foaming detergent compositions for automatic dishwashing machines, containing particular low foaming nonionics, builders, filler materials and enzymes, U.S. Pat. No. 3,472,783 to Smille recognized that degradation of the enzyme can occur, when an enzyme is added to a highly alkaline automatic dishwashing detergent.

French Patent No. 2,102,851 to Colgate-Palmolive, pertains to rinsing and washing compositions for use in automatic dishwashers. The compositions disclosed have a pH of about 6 to 7 and contain an amylolytic and, if desired, a proteolytic enzyme, which have been prepared in a special manner from animal pancreas and which exhibit a desirable activity at a pH in the range of about 6 to 7. German Patent No. 2,038,103 to Henkel & Co. relates to aqueous liquid or pasty cleaning compositions containing phosphate salts, enzymes and an enzyme stabilizing compound. U.S. Pat. No. 3,799,879 to Francke et al, teaches a detergent composition for cleaning dishes, with a pH of from 7 to 9 containing an amylolytic enzyme, and in addition, optionally a proteolytic enzyme.

U.S. Pat. No. 4,101,457, to Place et al., teaches the use of a proteolytic enzyme having a maximum activity at a pH of 12 in an automatic dishwashing detergent.

U.S. Pat. No. 4,162,987, to Maguire et al., teaches a granular or liquid automatic dishwashing detergent which uses a proteolytic enzyme having a maximum activity at a pH of 12 as well as an amylolytic enzyme having a maximum activity at a pH of 8.

U.S. Pat. No 3,827,938, to Aunstrup et al., discloses specific proteolytic enzymes which exhibit high enzymatic activities in highly alkaline systems. Similar disclosures are found in British Patent Specification No. 1,361,386, to Novo Terapeutisk Laboratorium A/S. British Patent Specification No. 1,296,839, to Novo Terapeutisk Laboratorium A/S, discloses specific amylolytic enzymes which exhibit a high degree of enzymatic activity in alkaline systems.

Thus, while the prior art clearly recognizes the disadvantages of using aggressive chlorine bleaches in automatic dishwashing operations and also suggests bleach-free compositions made by leaving out the bleach component, said art disclosures are silent about how to formulate effective bleach-free powdered automatic dishwashing compositions capable of providing superior performance during conventional use.

U.S. Pat. Nos. 3,821,118 and 3,840,480; 4,568,476, 4,501,681 and 4,692,260 teach the use of enzymes in automatic dishwashing detergents, as well as Belgian Patent 895,459; French Patents 2,544,393 and 1,600,256; European Patents 256,679; 266,904; 271,155; 139,329; and 135,226; and Great Britain Patent 2,186,884.

The aforementioned prior art fails to provide a powdered automatic dishwashing detergent which is phosphate-free and contains a mixture of enzymes for the simultaneous degradation of both proteins and starches, wherein the combination of enzymes have a maximum activity at a pH of less than about 11.5 to 12 as measured by Anson method and the powdered automatic dishwashing detergent has optimized cleaning performance in a temperature range of about 40° C. (104° F.) to about 65° C. (1500° F.).

It is an object of this invention to incorporate an enzyme mixture in a phosphate-free, powdered automatic dishwasher detergent composition for use in automatic dishwashing operations capable of providing at least equal or better performance to conventional automatic dishwashing compositions at operating temperatures of about 40° C. (104° F.) to about 65° C. (150° F.).

This instant invention relates to a spray dried phosphate-free powdered dishwashing composition containing a mixture of protease enzyme and an amylase enzymes have been found to be very useful in the cleaning of dishware. The compositions contain nonionic surfactants, a builder salt system, a zeolite and an alkali metal silicate and optionally, a bleaching agent and bleaching activator.

DETAILED DESCRIPTION

The present invention relates to a powdered automatic dishwashing detergent compositions which are formed by spray drying process and which comprise a nonionic surfactant, an alkali metal silicate, a phosphate-free builder system, a peroxygen compound with activator as a bleaching agent and a mixture of an amylase enzyme and a protease enzyme, wherein the spray dried, powdered automatic dishwashing detergent composition has a pH of less than 11.5 in the washing liquor at a concentration of 3 to 8 grams per liter of water. The spray dried, powdered dishwashing detergent composition exhibits high cleaning efficiency for both proteins and starches at a wash temperature of about 40° C. (104° F.) to about 65° C. (1500° F.).

The nonionic surfactants that can be used in the present powdered automatic dishwasher detergent compositions are well known. A wide variety of these surfactants can be used.

The nonionic synthetic organic detergents are generally described as ethoxylated/propoxylated fatty alcohols which are low-foaming surfactants and are possibly capped, characterized by the presence of an organic hydrophobic group and an organic hydrophilic group and are typically produced by the condensation of an organic aliphatic or alkyl aromatic hydrophobic compound with ethylene oxide and/or propylene oxide (hydrophilic in nature). Practically any hydrophobic compound having a carboxy, hydroxy, amido or amino group with a free hydrogen attached to the oxygen or the nitrogen can be condensed with ethylene oxide or propylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low-foaming polyalkoxylated lipophiles, wherein the desired hydrophile-lipophile balance is obtained from addition of an hydrophilic poly-lower alkoxy group to a lipophilic moiety. A preferred class of the nonionic detergent employed is the poly-lower alkoxylated higher alkanol, wherein the alkanol is of 9 to 18 carbon atoms and wherein the number of moles of lower alkylene oxide (of 2 or 3 carbon atoms) is from 3 to 15. Of such materials it is preferred to employ those wherein the higher alkanol is a high fatty alcohol of 9 to 11 or 12 to 15 carbon atoms and which contain from 5 to 15 or 5 to 16 lower alkoxy groups per mole. Preferably, the lower alkoxy is ethoxy but in some instances, it may be desirably mixed with propoxy, the latter, if present, usually being major (more than 50%) portion.

Exemplary of such compounds are those wherein the alkanol is of 12 to 15 carbon atoms and which contain about 7 ethylene oxide groups per mole.

Useful nonionics are represented by the low foam Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include Product A(a $C_{13}$–$C_{15}$ fatty alcohol condensed with 6 moles ethylene; oxide and 3 moles propylene oxide). Product B (a $C_{13}$–$C_{15}$ fatty alcohol condensed with 7 mole propylene oxide and 4 mole ethylene oxide), and Product C. (a $C_{13}$–$C_{15}$ fatty alcohol condensed with 5 moles propylene oxide and 10 moles ethylene oxide). Particularly good surfactants are Plurafac LF 132 and LF 231 which are capped nonionic surfactants. Another liquid nonionic surfactant that can be used is sold under the trade name Lutensol SC 9713. Another suitable nonionic surfactant for automatic dishwasher detergent from BASF is Industrol DW-5 having an average molecular weight of 1400 and is specially suitable for low temperature wash.

Synperonic nonionic surfactant from ICI such as Synperonic LF/D25 are especially preferred nonionic surfactants that can be used in the powdered automatic dishwasher detergent compositions of the instant invention.

Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18 which is alkoxylated linear alcohol and water dispersible and has a low cloud point and lower surface tension and lower foaming is very suitable for automatic dishwasher detergent.

Other useful surfactants are Neodol 25-7 and Neodol 23-6.5, which products are made by Shell Chemical Company, Inc. The former is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted. Tergitol MDS-42 surfactant from Union Carbide is specially suitable for machine dishwashing detergent.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company.

In the preferred poly-lower alkoxylated higher alkanols, to obtain the best balance of hydrophilic and lipophilic moleties the number of lower alkoxides will usually be from 40% to 100% of the number of carbon atoms in the higher alcohol, preferably 40 to 60% thereof and the nonionic detergent will preferably contain at least 50% of such preferred poly-lower alkoxy higher alkanol.

Mixtures of two or more of the liquid nonionic surfactants can be used and in some cases advantages can be obtained by the use of such mixtures.

During the spray drying process of the instant invention, the liquid non aqueous nonionic surfactant is absorbed on a builder system which comprises a mixture of phosphate-free particles which is a builder salt and a low molecular weight polyacrylate type polymer such as a polyacrylates, organic and/or inorganic detergent builders. A preferred solid builder salt is an alkali carbonate such as sodium carbonate or an alkali metal citrate such as sodium citrate or a mixture of sodium carbonate and sodium citrate. When a mixture of sodium carbonate and sodium citrate is used, a weight ratio of sodium citrate to sodium carbonate is about 9:1 to about 1:9, more preferably about 3:1 to about 1:3.

Other builder salts which can be mixed with the sodium carbonate and/or sodium citrate are gluconates, phosphonates, EDTA (ethylene diamine tetraacetic acid) and nitriloacetic acid salts. In conjunction with the builder salts are optionally used low molecular weight polyacrylates having a molecular weight of about 1,000 to about 100,000, more preferably about 2,000 to about 80,000. A preferred low molecular weight polyacrylate is Sokalan TM CP45 manufactured by BASF and having a molecular weight of about 70,000. Another preferred low molecular weight polyacrylate is Acusol TM LMW 445ND manufactured by Rohm and Haas and having a molecular weight of about 4,500. Norasol TM WL 2 comprises 26% LMW 445ND sprayed on 74% soda ash.

Sokalan TM CP 45 is a copolymer of an acrylic acid and an acid anhydride. Such a material should have a water absorption at 38° C. and 78 percent relative humidity of less than about 40 percent and preferably less than about 30 percent. The builder is commercially available under the trade name of Sokalan TM CP45. This is a partially neutralized copolymer of methacrylic acid and maleic anhydride sodium salt. Sokalan TM CP45 is classified as a suspending and anti-deposition agent. This suspending agent has a low hygroscopicity. Another builder salt is Sokalan TM CP 5 having a molecular weight of 70,000. An objective is to use suspending and anti-redeposition agents that have a low hygroscopicity. Copolymerized polyacids have this property, and particularly when partially neutralized. Acusol TM 445ND and Acusol TM 640ND provided by Rohm Haas are two useful suspending and anti-redepositing agent.

Zeolite A-type aluminosilicate builder, usually hydrated, with about 15 to 25% of water of hydration is used advantageously as the zeolite of the present invention. Hydrated zeolites X and Y may be useful too, as may be naturally occurring zeolites that can act as detergent builders. Of the various zeolite A products, zeolite 4A, a type of zeolite molecule wherein the pore size is about 4 Angstroms, is often preferred. This type of zeolite is well known in the art and methods for its manufacture are described in the art such as in U.S. Pat. No. 3,114,603.

The zeolite builders are generally of the formula $$(Na_2O)_x(Al_2O_3)_y(SiO_2)_z W\ H_2O$$

wherein x is 1, y is from 0.8 to 1.2, preferably about 1, z is from 1.5 to 3.5, preferably 2 to 3 or about 2, and w is from 0 to 9, preferably 2.5 to 6. The crystalline types of zeolite which may be employed herein include those described in "Zeolite Molecular Series" by Donald Breck, published in 1974 by John Wiley & Sons, typical commercially available zeolites being listed in Table 9.6 at pages 74.7–749 of the text, such Table being incorporated herein by reference.

The zeolite builder should be a univalent cation exchanging zeolite i.e., it should be an aluminosilicate of a univalent cation such as sodium, potassium, lithium (when practicable) or other alkali metal, or ammonium. A zeolite having an alkali metal cation, especially sodium, is most preferred, as is indicated in the, formula shown above. The zeolites employed may be characterized as having a high exchange capacity for calcium ion, which is normally from about 200 to 400 or more milligram equivalents of calcium carbonate hardness per gram of the aluminosilicate, preferably 250 to 350 mg. equivalents/gram on an anhydrous zeolite basis. The hydrated zeolites normally have a moisture or water of hydration content in the range of 5 to 30%, preferably about 15 to 25% and more preferably about 15 to 25% and more preferably 17 to 22%, e.g. about 20%. The zeolites are contained in the instant compositions at a concentration of about 2 to about 40 wt. %, more preferably about 4 to about 30 wt. %

The alkali metal silicates are useful anti-corrosion agents which function to make the composition anticorrosive to eating utensils and to automatic dishwashing machine parts. Sodium silicates of $Na_2O/SiO_2$ ratios of from 1:1 to 1:3.4, more preferably 1:1 to 1:2.8. Potassium silicates of the same ratios can also be used. The preferred silicates are sodium disilicate (anhydrous), sodium disilicate (hydrated) and sodium metasilicate and mixtures thereof, wherein the preferred silicate is hydrated disilicate.

Essentially, any compatible anti-foaming agent can be used. Preferred anti-foaming agents are silicone anti-foaming agents. These are alkylated polysiloxanes and include polydimethyl siloxanes, polydiethyl siloxanes, polydibutyl siloxanes, phenyl methyl siloxanes, dimethyl silinated silica, trimethysilanated silica and triethylsilanated silica. A suitable anti-foaming agent is Silicone TP-201 from Union Carbide. Other suitable anti-foaming agents are Silicone DB700 used at about 0.2 to about 1.0 percent by weight, sodium stearate used at a concentration level of about 0.5 to 1.0 weight percent, and LPKN 158 (phosphoric ester) sold by Hoechst used at a concentration level of about 0 to about 1.5 weight percent, more preferably about 0.1 to about 1.0 weight percent. The perfumes that can be used include lemon perfume and other natural scents.

A key aspect is to keep the free water (non-chemically bounded water) in the detergent composition at a minimum. Absorbed and adsorbed water are two types of free water, and comprise the usual free water found in a detergent composition. Free water will have the affect of deactivating the enzymes.

The detergent composition of the present invention can include a peroxygen bleaching agent at a concentration level of about 0 to about 20 weight percent, more preferably about 0.5 to about 17 weight percent and most preferably at about 1.0 to about 14 weight percent. The peroxygen bleaching agents that can be used are alkali metal perborate, percarbonate, perphthalic acid, perphosphates, and potassium monopersulfate. A preferred compound is sodium perborate monohydrate. The peroxygen bleaching compound is preferably used in admixture with an activator at a concentration level of 0 to 7 wt. percent; more preferably 1 to 5 wt. percent. Suitable activators are those disclosed in U.S. Pat. No. 4,264,466 or in column 1 of U.S. Pat. No. 4,430,244, both of which are herein incorporated by reference. Polyacetylated compounds are preferred activators. Suitable preferred activators are tetraacetyl ethylene diamine ("TAED"), pentaacetyl glucose and ethylidenebenzoate acetate.

The activator usually interacts with the peroxygen compound to form a peroxyacid bleaching agent in the wash water.

The detergent formulation also contains a mixture of a proteolytic enzyme and an amylotytic enzyme and, optionally, a lipolytic enzyme that serve to attack and remove organic residues on glasses, plates, pots, pans and eating utensils. Proteolytic enzymes attack protein residues, lipolytic enzymes attack fat residues and amylolytic enzymes attack starches. Proteolytic enzymes include the protease enzymes subtills, bromelin, papain, trypsin and pepsin. Amylolytic enzymes include amylase enzymes. Lipolytic enzymes include the lipase enzymes. The preferred amylase enzyme is available under the name Maxamyl, derived from Bacillus licheniformis and is available from Gist-Brocades of the Netherlands available in the form of a prill having an activity of about 6,000 TAU/g. Other amylase enzymes used in the application are Termamyl 60T from Novo Nordisk Bioindustrials and Amylase MT 300 from Solvay Enzymes. One preferred protease enzyme is available under the name Maxacal derived from Bacillus alcalophilus, and is supplied by Gist-Brocades, of the Netherlands in a prill form (activity of about 450,000 ADU/g.). Preferred enzyme activity per wash are Maxacal 100–700 KADU/g per wash and Maxamyl 1,000 to 4,000 TAU/g per wash. Another preferred protease enzyme is available under the name Maxatase derived from a novel Bacillus which is deposited with the Laboratory for microbiology of the Technical University of Delft and has a number OR-60, and is supplied by from Gist-Brocades, of the Netherlands in a prill form (activity of about 400,000 DU/g.). Preferred enzyme activates per wash are Maxatase 100–600 KDU per wash.

Another preferred protease enzyme is available under the names Maxapem CX 15, Maxapem CX 20, Maxapem CX 30 or Maxapem 42 which are high alkaline mutant proteolytic enzyme derived from Bacillus alcalophylus, and is supplied by from Gist-brocades, of the Netherlands in a prill form (activity of about 15–42 MPU/g). Preferred enzyme activity per wash of Maxapem 15, 20, or 42 are 3–100 MPU/g per wash or Maxapem 30 of 6–100 MPU/g per wash, wherein the Maxapem 15, 20, 30, or 42 exhibits improved resistance to activated oxygen (perborate) bleaching agents which can be used in the instant composition. Other protease enzymes suitable for this application are Opticlean M375 Plus from Solvay Enzymes and Biosam AP 1.5 from Showa Denko America. Another preferred enzyme in Durazym from Novo Nordisk. Another preferred protease enzyme is Esperase 6.0T from Novo Nordisk Bioindustrials.

The weight ratio of the proteolytic enzyme to the amylolytic enzyme in prill form the powdered automatic dishwasher detergent compositions is about 6:1 to about 1:1, and more preferably about 4.5:1 to about 1:1.

The detergent composition can have a fairly wide ranging composition. The surfactant can comprise 0 to 15 percent by weight of the composition, more preferably about 0.1 to 10 percent by weight, and most preferably about 1 to about 6 percent by weight. The antifoaming agent will be present in an amount of about 0 to 1.5 percent by weight, more preferably about 0.1 to about 1.2 percent by weight and most preferably about 0.1 to about 1 percent by weight. The builder system, which is preferably sodium carbonate and/or sodium citrate, is present in an amount of about 2 to about 40 percent by weight, more preferably about 4 to about 40 percent by weight and most preferably about 5 to about 30 percent by weight. The builder system also preferably contains the low molecular weight polyacrylate type polymer at a concentration level of about 0 to about 20 weight percent, more preferably 1.0 to about 17 weight percent and most preferably about 5 to about 17 weight percent and a zeolite at a concentration level of about 2 to about 40 weight percent, more preferably about 3 to about 35 weight percent, and most preferably about 4 to about 30 weight percent. The composition also can include the peroxygen bleaching agent at a concentration of about 0 to 20 wt. percent and a bleach activator at a concentration of about 0 to 7 wt. percent.

The alkali silicate, which is a corrosion inhibitor, wherein sodium disilicate is preferred, will be present in the composition at an amount of about 0 to 40 percent by weight, more preferably about 3 to about 35 percent by weight and most preferably about 4 to about 30 percent by weight.

The enzymes will be present in the composition in an amount in a prill form as supplied by Gist-brocades at a concentration of about 0.8 to 20.0 percent by weight, more preferably about 0.9 to 18.0 percent by weight, and most preferably about 1.0 to about 16.0 percent by weight. The protease enzyme prills in the automatic dishwashing composition will comprise about 0.5 to about 10.00 percent by weight, more preferably about 0.7 to about 9.0 weight percent and most preferably about 0.8 to about 8.0 percent by weight. The amylase enzyme prills will comprise about 0.3 to about 10.00 percent by weight, more preferably about 0.4 percent to about 9.0 weight percent and most preferably about 0.5 to about 8.0 weight percent. The lipase enzyme prills will comprise 0.00 to about 8.0 percent by weight of the detergent composition. A typical lipase enzyme is Lipolase 100T from Novo Corporation. The lipase enzymes are especially beneficial in reducing grease residues and related filming problems on glasses and dishware. Another useful lipase enzyme is Amano PS lipase provided by Amano International Enzyme Co., Inc. Another useful Lipase enzyme is Lipomax available from Gist-brocades (IBIS). Other components such as perfumes will comprise about 0.1 to about 5.0 percent by weight of the detergent composition.

One method of producing the powder detergent formulation having a bulk density of about 0.7 to 0.9 gram/cc is to spray dry by any conventional means the nonionic surfactant and defoamer onto the perborate bleach compound and the builder salt. This spray dry materials can be used immediately, but it is preferred to age it for 24 hours. The spray dried materials are dry blended in any suitable conventional blender such as a tumble blender or twin-shell mixer at about room temperature with the other ingredients of the composition until a homogeneous blend is obtained.

The instant compositions also can be produced as low density powders according to the procedure as set forth in U.S. Pat. No. 4,931,203 which is hereby incorporated by reference, wherein these powders have a bulk density less than the bulk density of the standard powders which have a bulk density of about 0.95 kg/liter.

The free-flowing spray-dried particulate automatic detergent composition of the instant invention has a density of from about 0.3 to about 1.0 g/cc and contain a zeolite and one or more anionic, nonionic and/or cationic surface active detergent compounds, wherein the detergent composition has improved particle mechanical strength and integrity to allow extensive storage and handling of the composition with only minimum breakage and abrasion of the particles concomitant with high solubility characteristics such that the amount of visible residue deposited on dishware with such detergent composition is significantly minimized. The process for producing these compositions comprises:

(a) forming an aqueous crutcher slurry containing (i) at: least about 5%, by weight, of a zeolite; (ii) an effective amount of a bead strengthening agent selected from the group consisting of citric acid, water-soluble salts of citric acid, EDTA, nitrilotriacetate, water-soluble salts of nitrilotriacetate and mixtures thereof; and (iii) from about 0 to 50%, by weight, of a supplementary detergent builder other titan (i) and (iii); said crutcher slurry being essentially free of sodium silicate and bentonite and containing less than about 3%, by weight, of nonionic and/or anionic surface active detergent compounds, wherein all percentages are based on the solids content of the slurry, in the absence of water;

(b) spray-drying the crutcher slurry of step (a) to produce spray-dried particles; and (c) applying one or more anionic, nonionic and/or cationic surface active detergent compounds to the spray-dried particles in an amount sufficient to obtain the desired detergency properties for said particulate detergent composition.

The exclusion of sodium silicate from the aqueous crutcher slurry in preparing zeolite-containing spray-dried particles, the inclusion of a bead strengthening agent as herein described and the restriction on the amount of surfactant in the crutcher slurry are three important process parameters which when practiced in combination provide a particulate automatic dishwasher detergent composition having excellent mechanical strength and integrity as well as superior washing characteristics such that dishware cleaned therewith are substantially free of the characteristic residue observed on dishware washed with most commercially available powdered automatic dishwashing compositions.

Restriction on surfactant compounds in the crutcher slurry is required because the presence of nonionic or anionic surface active detergent compounds in the crutcher in significant amounts adversely affects the mechanical strength and integrity of the spray-dried particles leaving the tower (commonly referred to as "tower particles") as well as diminishing the absorptivity of such particles for oversprayed surfactant in a subsequent processing step. In the absence of sodium silicate, which ordinarily serves to enhance particle integrity, anionic and nonionic surfactants have the effect of expanding the particles formed during spray-drying such that depending on the amount present, fragmented and dusty particles are formed substantially lacking mechanical strength. The addition of surfactants to the crutcher also tends to undermine the desirable free-flowing characteristics of the tower particles, producing instead a tacky particulate material having the tendency to form "clumps" or agglomerates when compressed during storage or handling. In accordance with the invention, the level of anionic and nonionic surface active compounds in the crutcher slurry is maintained below about 3%, by weight, preferably below about 1%, by weight, and most preferably is substantially free of nonionic and anionic surfactant compounds, the above percentages being based on the solids content of the slurry, in the absence of water.

Another significant feature of this preferred process of the instant invention is that it is capable of providing spray-dried particulate compositions over a range of densities up to about 1.0 g/cc. This is particularly important for the manufacture of so-called concentrated and super concentrated automatic dishwasher detergent powders which require high density products capable of providing effective cleaning at recommended dosages of 25 grams or about 25 to 50 grams of product per wash.

Conventional spray-drying processes are generally unable to manufacture spray-dried detergent compositions at densities typically required to provide as an effective low dosage product. In accordance with the preferred process, the density of the particles leaving the spray tower can be as high as 0.9 g/cc. Further increases in density are effected during the post-addition of the surfactant detergent compounds as well as upon addition of optional post-added ingredients such as bleaches, activators, supplementary builders, clay, perfume and the like.

The density of tower particles are conveniently regulated in accordance with the invention by the addition to the crutcher slurry of an organic "density modifying agent" which lowers the density of the spray-dried particle by creating, in effect, an expanded particle or bead during spray drying. The amount of such modifying agent added to the crutcher slurry will generally be from about 0.01% to 5% depending on the desired density of the tower particles. Preferred density modifying agents for use herein include organic materials such as sodium toluene sulfonate and homopolymers and copolymers of acrylic acid such as with maleic anhydride or methacrylate in a range of molecular weight from 2000 to 200,000, sodium polyacrylate being particularly preferred for this purpose in a molecular weight range of 40,000 to 60,000. Other useful density modifying agents include sodium xylene sulfonate.

The bead strengthening agent is generally added to the slurry in an amount of from about 1 to about 50%, preferably at least about 3%, such as, from about 3 to 30%, and most preferably from about 5 to 20%, by weight, based on the solids content of the slurry in the absence of water. An alkali or alkaline earth metal salt of citric acid is preferred for this purpose, most preferably sodium citrate.

Generally, an aqueous crutcher slurry is formed containing a mixture of water with many or most of the ingredients desired in the final detergent composition. The solids content of the slurry is generally from about 40% to about 70%, preferably 50% to 65% thereof, the balance being water. The crutcher slurry is then atomized by pumping it through a nozzle at a pressure of about 500 psi into a spray-drying tower, the typical dimensions of a commercial tower being about 35–100 feet in height and about 12–30 feet in diameter. At the base of the tower, air is introduced at a temperature of from about 300°–1000° F. which contacts the atomized slurry to provide a hot drying gas for the droplets of the slurry thereby evaporating most of the water. The resulting particles or beads are collect at the bottom of the tower, the moisture and heated air existing at the top. Heat or water-sensitive ingredients such as perfume, bleach, activator and enzymes are conventionally post-added to the tower particles in a subsequent mixing or blending operation.

The crutcher slurry is preferably made by sequentially adding the various components thereof in the manner which will result in the most miscible, readily pumpable and non-setting slurry for spray drying. The order of addition of the various components may be varied, depending on the circumstances. Normally it is preferable for all or almost all of the water to be added to the crutcher first, preferably at about the processing temperature, after which the processing aids, such as density modifying agents, e.g. sodium polyacrylate and sodium toluene sulfonate, and other minor components, including pigments and dyes are added, followed by a supplementary builder, if present, such as sodium bicarbonate or carbonate and the bead strengthening agent, e.g. sodium citrate. Finally, the zeolite and any filler salts, such as sodium sulfate, are added to the crutcher mix. Usually, during such additions, each component will be mixed in thoroughly before addition of the next component but methods of addition may be varied, depending on the circumstances, so as to allow co-additions when such are feasible. Sometimes component additions may be in two or more parts to effect good mixing, e.g. during zeolite addition. Different components may sometimes be premixed before addition to speed the mixing process. Normally, mixing speed and power will be increased as the materials are added. For example, low speeds may be used until after admixing in of the supplementary builder and the bead strengthening agent; after which the speed may be increased during and after addition of the zeolite to provide a homogeneous slurry mix.

The temperature of the aqueous medium in the crutcher will usually be about room temperature or elevated, normally being in the 20° to 70° C. range, and preferably from about 25° to 40° C. Heating the crutcher medium may promote solution of the water soluble salts of the mix and thereby increase miscibility, but the heating operation, when effected in the crutcher, can slow production rates. Temperatures higher than 70° C. are usually avoided because of the possibility of decomposition of one or more crutcher mix components, e.g., sodium bicarbonate.

Crutcher mixing times to obtain thoroughly mixed homogeneous slurries can vary widely, from as little as five minutes in small crutchers and for slurries of higher moisture contents, to as much as two hours, in some cases, although 30 minutes is a preferable upper limit.

The uniform crutcher slurry is thereafter transferred in the usual manner to a spray drying tower, which is located near the crutcher. The slurry is normally dropped from the bottom of the crutcher to a positive displacement pump, which forces it at high pressure through spray nozzles into the spray tower (countercurrent or concurrent), wherein the droplets of the slurry fall through a hot drying gas to form absorptive particles or beads.

After drying, the product is screened to desired size, e.g., 10 to 100 mesh, U.S. Sieve Series, and is ready for application of a nonionic detergent overspray in a mixing drum onto the tumbling particles, the particles or beads being either in warm or cooled (to room temperature) condition. The nonionic detergent normally penetrates to below the bead surface.

The zeolites, as charged to a crutcher slurry from which beads or particles are spray-dried, should be in finely divided state, with the ultimate particle diameters being up to 20 microns, preferably 0.01 to 8 microns mean particle size, e.g., 3 to 7 microns, if crystalline, and 0.01 to 0.1 micron, e.g., 0.01 to 0.05 micron, if amorphous. Although the ultimate particle sizes are much lower, usually the zeolite particles are of sizes within the range of No. 100 to 400 sieve, preferably no. 140 to 325 sieve, as charged to the crutcher.

The weight percent of zeolite in the crutcher slurry is at least about 5% for purposes of the invention, preferably from about 5 to 50%, and most preferably from about 10 to 40%, by weight, based on the solids content of the slurry.

A nonionic surfactant as previously described is conveniently added to the tower beads to form a detergent composition by post-spraying onto surfaces of the particles in a blender or mixing drum.

The concentrated powdered nonionic automatic dishwashing detergent compositions of the present invention disperses readily in the water in the dishwashing machine. The presently used home dishwashing machines have a measured capacity for about 80 cc or 90 grams of detergent. In normal use, for example, for a full load of dirty dishes 50 grams of powdered detergent are normally used.

In accordance with the present invention only about 30 cc or about 25 grams of the concentrated powdered detergent composition is needed. The normal operation of an automatic dishwashing machine can involve the following steps or cycles: washing, rinse cycles with cold water and rinse cycles with hot water. The entire wash and rinse cycles require about 60 minutes. The temperature of the wash water is about 40° C. (104° F.) to about 65° C. (150° F.) and the temperature of the rinse water is about 55° C. (130° F.) to about 65° C. (150° F.). The wash and rinse cycles use about 4 to 10 liters of water for the wash cycle and about 4 to 10 liters of water for the hot rinse cycle.

The highly concentrated powdered automatic dishwashing detergent compositions exhibit excellent cleaning properties and because of the high concentration of the detergent in the composition, the detergent is not totally consumed during the wash cycle or totally eliminated during the rinse cycle such that there is a sufficient amount of detergent remaining during the rinse cycle to substantially improve the rinsing. The washed and dried dishes are free of undesirable traces, deposits or film due to the use of hot water in the rinse cycle.

The following examples are given to illustrate the compositions of the invention, but said examples are not intended to limit the scope of the disclosure of this invention. All amounts and percentages are by weight unless otherwise indicated.

EXAMPLES I, II, III

Phosphate-Free Ultra Concentrated Powder Automatic Dishwasher Detergent

Formula Comparison and Performance Data

Single Dosage=25 g, ½ of Standard Powder Automatic Dishwasher Detergent

TABLE I

| Ingredients | Formula Composition A | B | C |
|---|---|---|---|
| No-P Base Bead | 63.00 | 38.00 | — |
| Sod. Al. Silicate (Zeoite A) | 22.94 | 13.84 | |
| Sodium Carbonate | 11.89 | 7.17 | 28.00 |
| Sodium Polyacrylate | 4.43 | 2.67 + 10.00 | 10.00 |
| Sodium Sulfate | 3.88 | 2.34 | |
| Sodium Citrate $2H_2O$ | 2.92 | 1.76 + 15.00 | 25.00 |
| Phorwite HRS | 0.48 | 0.29 | |
| Sodium Toluene Sulfonate | 0.05 | 0.03 | |
| Moisture | 16.41 | 9.90 | |
| | | 38.00 + 25.00 | |
| Total | 63.00 | 63.00 | 63.00 |
| Sodium Silicate-Britesil H20 (1:2) | 25.00 | 25.00 | 25.00 |
| Poly Tergent SLF 18 (Nonionic Surfactant) | 4.00 | 4.00 | 4.00 |
| Maxatase Prilled (P 400,000) | 6.00 | 6.00 | 6.00 |
| Maxamyl Prilled (CX 5000) | 2.00 | 2.00 | 2.00 |
| Sodium Perborate Monohydrate | — | — | — |
| Tetra Acetyl Ethylene Diamine | — | — | — |
| | 100.00 | 100.00 | 100.00 |

TABLE II

Cleaning Performance Data: Multisoil Test

| | A | B | C | Commercial Sun Progress Sample |
|---|---|---|---|---|
| TAP (120 ppm), 130° F. | | | | |
| Egg Yolk ($CaCl_2$ Treated) % Clean | 92 | 89 | 93 | 41 |
| Oatmeal Baked % Clean | 100 | 100 | 100 | 100 |
| Spot | 1.0 | 1.0 | 1.0 | 2.3 |
| Film | 1.5 | 2.3 | 2.0 | 2.5 |
| pH (1% Solution) | 10.78 | 10.89 | 10.89 | 10.56 |
| Hard (300 ppm), 130° F. | | | | |
| Egg Yolk ($CaCl_2$ Treated) % Clean | 80 | 76 | 69 | 44 |
| Oatmeal Baked % Clean | 100 | 100 | 100 | 100 |
| Spot | 1.0 | 1.0 | 1.0 | 3.0 |
| Film | 3.0 | 3.0 | 2.5 | 2.5 |

The zeolite based base bead was made by the spray-dried tower process as described before. In example I(A), 4% Poly Tergent SLF-18 nonionic surfactant was absorbed onto 63% of base bead (composition broken down in the example shown in Table 1) and mixed in the twin-shelled mixer until all surfactant was totally absorbed onto the base beads. Powdered hydrated Sodium Silicate in the amounts of 25% was then added to the surfactant treated base and mixed thoroughly and was followed by protease and amylase addition until homogeneously mixed. Similarly, compositions of example II (B) and example III (C) were prepared. Sun Progress is a European phosphate-free commercial product whose approximate composition was given.

Laboratory performance of the compositions of the Example I, II, III and commercial Sun Progress were carried out using multi-soils. This was done to show differences between the prototype formulations and commercial products. Egg soil was prepared by mixing egg yolk with an equal amount of 2.5 N Calcium Chloride solution. This mixture was applied as thin crosswise film to the usable surface of 7.5 inch china plates. The plates were aged in 50% relative humidity overnight. Oatmeal soil was prepared by boiling 24 grams of Quaker Oats in 400 ml of tap water for ten minutes. Three grams of this mixture was spread as thin film onto a 7.5 inch china plate. The plates were aged for 2 hours at 80° C. They were then stored overnight at room temperature. Two plates of each egg and oatmeal were used per wash. The plates were placed in the same positions in the dishwasher. Twenty-five grams of the detergent was used as a single dose per wash. All plates were scored by measuring the percent area cleaned. The multi-soil cleaning test results are reported below. The results tabulated in Table II were average of at least 2 runs. Average results reflect the average performance results obtained in four consecutive cycles in the same water conditions. The product was tested also with 25 gram dose using the ASTM method D3556-79 spotting and filming test method combined with denatured egg soiled (egg yolk denatured with 2.5 M $CaCl_2$ solution) along with the 25 g dose of commercial Sun Progress powder product. Enzyme containing prototype powder ADD completely removed egg soil and of oatmeal, whereas, commercial Powder partially removed the egg soil.

EXAMPLE IV and V

TABLE III

| Ingredients | IV (D) | V (E) |
|---|---|---|
| Zeolite A | 20 | 20 |
| Sodium Carbonate | 13.50 | 13.50 |
| Polymer: Soda Ash (WL-2)* | 17.00 | 17.00 |
| Sodium Citrate | 10.00 | 10.00 |
| Sodium Silicate - Britesil H2O | 25.00 | — |
| Sodium Silicate - Britesil H24 | — | 25.00 |
| Maxacal CXT 450,000 | 4.00 | 4.00 |
| Maxamyl CXT 5,000 | 1.00 | 1.00 |
| Poly Tergent SLF-18 | 4.00 | 4.00 |
| | 94.50 | 94.50 |
| Balance Moisture | | |
| pH (1% solution) | 11.07 | 10.89 |

*WL-2: an agglomeration mixture of 30% polyacrylate Acusol 445N and 70% soda ash

TABLE IV

Cleaning Performance Data: Multisoil Test

| | Ex. IV (D) | Ex. V (E) |
|---|---|---|
| 300 ppm, 140° F. - 4 cycle average | | |
| Egg cleaning % | 94 | 92 |
| Oatmeal cleaning % | 100 | 100 |
| Spot | 1.0 | 1.0 |
| Film | 2.1 | 2.2 |
| 500 ppm, 140° F. - 2 cycle average | | |
| Egg cleaning % | 95 | 95 |
| Oatmeal cleaning % | 100 | 100 |
| Spot | 1.0 | 1.0 |
| Film | 3.5 | 3.3 |

Prototype formulations shown in the Examples IV and V were made by dry blending in the twin-shelled mixer. Poly Tergent SLF 18 was absorbed on Sodium Carbonate, WL-2 and Sodium Silicate. After thorough mixing, Zeolite A, Sodium Citrate were added and mixed, followed by Maxacal and Maxamyl enzymes. The formulation difference between examples IV and V was the use of different grade of silicates which did not make any difference in cleaning performance as shown in Table IV.

TABLE V

EXAMPLE VI (F)

| Ingredients | |
|---|---|
| Zeolite Base Bead | 55% |
| Sodium Zeolite | 20.03 |
| Sodium Carbonate | 10.38 |
| Sodium Polyacrylate | 3.89 |
| Sodium Citrate | 2.55 |
| Balance Moisture | — |
| Sodium Carbonate | 10.00 (total 20.38) |
| Sodium Polyacrylate (Acusol 445ND) | 1.50 (total 5.56) |
| Sodium Citrate | 4.50 (total 7.05) |
| Sodium Silicate - Britesil H24 | 25.00 |
| Poly Tergent SLF-18 | 4.00 |
| Maxacal CXT 450,000 | 4.00 |
| Maxamyl CXT 5,000 | 1.00 |

TABLE VI

Cleaning Performance Data: Multisoil Test
300 ppm - 130° F.: 4 Cycles Average

| Dose Per Wash | EXAMPLE VI 25 gram | Colgate-Palmolive Institutional Phosphate/ClBleach 50 Gram |
|---|---|---|
| Egg Cleaning % | 92 | 55 |
| Oatmeal Cleaning % | 100 | 98 |
| Spot | 1.0 | 1.0 |
| Film | 2.5 | 2.5 |

Institutional product is a contract manufactured CP formula which is a highly alkaline, phosphate and chlorine bleach containing standard formula designed for industrial and institutional usage and made by dry blending of all ingredients by conventional means. Formula composition shown in example VI was made from zeolite based base bead according to the procedure given in the example I.

EXAMPLE VII, VIII

Spray dried automatic dishwashing detergent powders in accordance with the invention having the ingredients shown below were prepared as follows, wherein all percentages referring to the crutcher slurry are based on the solids content of the slurry in the absence of water.

TABLE VIII

| Ingredients | Weight Percent Example VII (G) | Example VIII (H) |
|---|---|---|
| Poly Tergent SLF 18 | 4.0 | 4.0 |
| Zeolite A | 20.0 | 18.0 |
| Sodium Sulfate | 3.0 | 1.5 |
| Sodium Carbonate | 25.0 | 25.0 |
| Sodium Polyacrylate (Acusol 445ND) | 5.0 | 8.5 |
| Sodium Citrate $2H_2O$ | 10.0 | 10.0 |
| Sodium Silicate (1:2.4) | 25.0 | 25.0 |
| Maxacal CXT 450,000 | 4.0 | 4.0 |
| Maxamyl CXT 5,000 | 1.0 | 1.0 |
| Water as moisture | Balance | Balance |

An aqueous crutcher slurry was prepared by adding to water at 38° C., the sodium polyacrylate while mixing with a turbine blade mixer at a low speed (10–50 rpm). After about 1 minute of agitation, there was added to the slurry sodium carbonate and sodium citrate while mixing at a high speed (100 rpm) for 1–2 minutes. Zeolite was then added in 4 equal parts to the slurry to insure proper mixing. The mixer speed during the latter additions was at 200 rpm. All of the aforementioned percentages are based on the solids content of the slurry, in the absence of water.

The finished batch temperature of the crutcher was about 55° C. and the solids content was 60%. From the crutcher, the slurry was dropped into a large hold tank prior and pumped to a spray tower for spray drying. Typical spray pressures for this product was 500 pounds per square inch. Inlet air temperatures was about 400°–450° C. and the outlet air temperatures were about 95°–105° C. The tower particles exiting the spray tower were transported to a rotary mixing drum where the nonionic surfactant heated to about 50° C. was oversprayed onto the tumbling particles. The sodium silicate and the enzymes Maxacal and Maxamyl, and perfume were then added, to the ,mixing drum.

The finished particulate detergent composition was used as a dishwashing detergent composition for automatic dishwashing machines.

EXAMPLE IX, X

TABLE IX

| Ingredients | Example IX (I) Dry Blend Making | Example X (J) Base Bead 50% | |
|---|---|---|---|
| Zeolite A | 18.00 | Zeolite | 18.21 |
| Sodium Carbonate | 25.00 | Sodium Carbonate | 9.44 |
| Polyacrylate-Acusol 445ND | 8.5 | Polyacrylate-Acusol 445ND | 3.52 |
| Sodium Citrate | 10.00 | Sodium Citrate | 2.32 |
| Sodium Sulfate | 3.00 | Sodium Sulfate | 3.08 |
| Moisture | 1.50 | Moisture, Additives | Balance |
| Sodium Silicate-Britesil H24 | 25.00 | Sodium Silicate-Britesil H24 | 25.00 |
| Poly Tergent SLF 18 | 4.00 | Poly Tergent SLF 18 | 4.00 |
| Maxacal CXT 450,000 | 4.00 | Maxacal CXT 450,000 | 4.00 |
| Maxamyl CXT 5000 | 1.00 | Maxamyl CXT 5000 | 1.00 WL 2 |
| (30:70 Polymer:Soda Ash) | — | WL 2 (30:70 Polymer: | |
| | 100.00 | Soda Ash) | 16.67 |
| | | Sodium Carbonate | 4.00 |
| | | Sodium Citrate | 8.00 |
| | | | 100.00 |

TABLE X

| Cleaning Performance Data: Multisoil Test 300 ppm - 140° F.: 4 Cycles Average | | |
|---|---|---|
| | Example IX (I) | Example X (J) |
| Egg cleaning % | 90 | 86 |
| Oatmeal cleaning % | 100 | 100 |
| Spot | 1.0 | 1.0 |
| Film | 3.3 | 3.6 |

Formula Composition in the example IX was made by dry blending all the ingredients in the twin-shelled mixer using standard procedure whereas, example X composition was made from zeolite based based bead and post adding remaining ingredients.

What is claimed is:

1. A spray dried powdered automatic dishwashing detergent composition having a density of 0.7 to 0.9 g/cm3 which approximately consists essentially of in percent by weight:

(a) 2 to 40% of zeolite A;

(b) 1 to 17% of a low molecular weight polyacrylate polymer;

(c) 3 to 35% of an alkali metal silicate;

(d) 0.1 to 10% of a liquid nonionic surfactant;

(e) 2 to 40% of a builder salt;

(f) 0.1 to 1.2% of an anti-foaming agent;

(g) 0.5 to 10% of a protease enzyme;

(h) 0.3 to 10% of an amylase enzyme;

(i) 0.01 to 5% of an sodium toluene sulfonate or sodium xylene sulfonate;

(j) 0.5 to 17% of a peroxygen bleaching agent;

(k) 1 to 5% of a peroxygen bleach activator (1) .048% whitening agent.I.

2. The composition according to claim 1, wherein a weight ratio of said protease enzyme to said amylase enzyme being about 4:1 to about 1:1, wherein said detergent dishwashing composition has a pH of 1% solution less than 11.0.

3. The composition according to claim 1, wherein said liquid surfactant is a nonionic liquid surfactant.

4. The composition according to claim 1, herein said low molecular polyacrylate polymer is present at a concentration level of about 0 to about 17.0 wt. %.

5. The composition according to claim 4, wherein said builder salt is phosphate free and is present at a concentration level of about 4.0 to about 40.0 wt. %.

6. The composition according to claim 5, wherein said builder salt is phosphate-free and is selected from the group consisting of sodium carbonate, sodium citrate, sodium gluconates, sodiumphosphonates and nitriloacetate and mixtures thereof.

* * * * *